US007003868B2

(12) United States Patent
Preimesberger

(10) Patent No.: US 7,003,868 B2
(45) Date of Patent: Feb. 28, 2006

(54) COATED STAINLESS-STEEL/COPPER WELD FOR ELECTROPLATING CATHODE

(75) Inventor: Neal J. Preimesberger, Tucson, AZ (US)

(73) Assignee: T.A. Caid Industries Inc., Tucson, AZ (US)

( * ) Notice: Subject to any disclaimer, the term of this patent is extended or adjusted under 35 U.S.C. 154(b) by 406 days.

(21) Appl. No.: 10/374,944

(22) Filed: Feb. 26, 2003

(65) Prior Publication Data

US 2004/0163966 A1 Aug. 26, 2004

(51) Int. Cl.
*B23P 19/00* (2006.01)

(52) U.S. Cl. ..... 29/746; 29/747; 29/761; 29/729; 29/825; 29/869; 29/877; 29/878; 29/879; 204/281; 204/286.1; 204/297.01

(58) Field of Classification Search ..... 29/825, 29/869, 877, 878, 879, 746, 747, 729, 761; 204/281, 286.1, 297.01
See application file for complete search history.

(56) References Cited

U.S. PATENT DOCUMENTS

| | | | | |
|---|---|---|---|---|
| 4,186,074 A | | 1/1980 | Perry | 204/286 |
| 5,492,609 A | | 2/1996 | Assenmacher | 204/286 |
| 5,919,343 A | * | 7/1999 | Sparapani | 204/288.1 |
| 6,485,621 B1 | * | 11/2002 | Del Rincon et al. | 204/281 |
| 6,531,038 B1 | * | 3/2003 | Knies et al. | 204/286.1 |
| 6,569,300 B1 | * | 5/2003 | Assenmacher | 204/286.1 |
| 2003/0010630 A1 | * | 1/2003 | Polvi et al. | 204/280 |
| 2005/0126906 A1 | * | 6/2005 | Webb | 204/279 |

* cited by examiner

*Primary Examiner*—Bruce F. Bell
(74) *Attorney, Agent, or Firm*—Antonio R. Durando; Quarles & Brady Streich Lang, LLP

(57) ABSTRACT

A copper welding rod is used in an arc-welding operation to form a bead that joins a copper starter sheet and a stainless steel hanger bar. The amperage level of the arc-welding equipment is set to generate heat at the weld site which is above the melting point of copper and below the melting point of stainless steel. This results in a welded joint between the copper bead and the hanger bar and a brazed joint between the copper bead and the starter sheet. Since brazing produces little or no fusion, the area of contact between the two dissimilar metals is limited to the interface between them, which significantly reduces the damaging effects of galvanic corrosion. Another improvement lies in the application of a corrosion-resistant metallic coating on the joint between the hanger bar and the starter sheet using a high velocity oxygen fuel flame spray technique.

20 Claims, 4 Drawing Sheets

COATED STAINLESS-STEEL/COPPER WELD FOR ELECTROPLATING CATHODE

BACKGROUND OF THE INVENTION

1. Field of the Invention

This invention relates in general to electrolytic processes and equipment for refining copper and more particularly to an improved electrolytic cathode and method of making same.

2. Description of the Prior Art

The principle of electrolysis has been utilized for decades to extract metals and other cations from an electrolytic solution. The extraction process is carried out by passing an electric current through an electrolyte solution of the metal of interest, such as copper, gold, silver or lead. The metal is extracted by electrical deposition as a result of current flow between a large number of anode and cathode plates immersed in cells of a dedicated extraction tank house. The anode is made of a material that is dissolved and therefore lost during the process, while the cathode is constructed of a metal alloy, such as titanium or copper alloys and various grades of stainless steel (316L, 2205, etc.), which are resistant to corrosive acid solutions. In the most efficient processes, each cathode consists of a thin sheet of metal having a uniform thickness (2–4 mm) disposed vertically between parallel sheets of anodic material, so that an even current density is present throughout the surface of the cathode. A solution of metal-rich electrolyte and various other chemicals, as required to maintain an optimal rate of deposition, are circulated through the extraction cells; thus, as an electric current is passed through the anodes, electrolyte and cathodes, a pure layer of electrolyte metal is electro-deposited on the cathode surface, which becomes plated by the process.

Similarly, to purify a metal in a refinery process using electro-deposition, an anode of impure metal is placed in an electrolytic solution of the same metal and subjected to an electric current passing through the anode, electrolyte and cathode of each cell. The anode goes into solution and the impurities drop to the bottom of the tank. The dissolved metal then follows the current flow and is deposited in pure form on the cathode, which typically consists of a starter sheet of stainless steel. When a certain amount of pure metal has been plated onto the starter sheet, the cathode is pulled out of the tank and stripped of the pure metal.

In both processes, the pure metal deposit is grown to a specific thickness on the cathode during a predetermined length of time and then the cathode is removed from the cell. It is important that the layer of metal deposited be recovered in uniform shaped and thicknesses and that its grade be of the highest quality so that it will adhere to the cathode blank during deposition and be easily removed by automated stripping equipment afterwards. The overall economy of the production process depends in part on the ability to mechanically strip the cathode of the metal deposits at high throughputs and speeds without utilizing manual or physical intervention. To that end, the cathode blanks must have a surface finish that is resistant to the corrosive solution of the tank house and must be strong enough to withstand their continuous handling by automated machines without pitting or marking. Any degradation of the blank's finish causes the electro-deposited metal to bond with the cathode resulting in difficulty of removal and/or contamination of the deposited metal.

Also immensely important in the production and refining of metals by electrolytic extraction is the relationship of electrical power consumption with metal production rates. The total weight of deposited metal can be calculated theoretically by knowing the actual energy used, the concentration of metal in solution, the average residence time, the number of cells, and the surface area available for deposition in each cell. In practice, all electrical amperages and flow rates are continuously monitored throughout the deposition cycle to optimize the electrolytic process. After the cathodes have been pulled out of the cells and the deposited metals have been stripped and weighed, the electrolytic-production weight is divided by the theoretical cell production weight to determine cell efficiency. A cell efficiency of ninety-five percent or better is the goal for the best operations.

In order to achieve this level of efficiency, the voltage profile across the cathodic deposition surface must be held constant and variations avoided. Shorts due to areas of high current density caused by nodulization or by curved cathode surfaces that touch the anode must be prevented. Therefore, the details of construction of cathode blanks are very important to minimize operational problems and ensure high yields.

U.S. Pat. No. 4,186,074 issued to Perry in 1980 describes a cathode for electrolytic refining of copper that was considered to be the state of the art in the industry. It consists of a stainless steel hanger bar with the top edge of a stainless steel starter sheet in abutting relationship with the flat bottom surface of the hanger bar. Stitch welding is used to attach the starter sheet to the hanger bar so that it depends vertically from the hanger bar. The opposite ends of the hanger bar are supported on a spaced-apart pair of horizontally disposed bus bars and are in electrically conductive contact therewith for energizing the system. In order to reduce the electrical resistance resulting from the spot welds between the hanger bar and the starter sheet, the hanger bar and the upper edge of the starter sheet are uniformly clad with copper, thereby creating a low resistance boundary between the two.

The cathode structure disclosed in the Perry patent was a significant improvement over the prior art; however, some of its features caused problems from time to time. The flat bottom surface of the hanger bar tended to remain positioned in full contact with the bus bars even when the starter sheet was not perfectly perpendicular to it because of warpage or other structural defects. In such cases, the starter sheet would not hang perfectly vertical and its distance from adjacent anodes was not uniform and sometimes it would even be in shorted contact with the anodes. This caused nonuniform deposits that affected the efficiency of operation and the quality of the product. Another problem with the Perry cathode resulted from wear which caused pits and faults to develop in the copper cladding around the hanger bar. When this occurred, the steel of the hanger bar underneath the copper cladding was exposed to the highly corrosive atmosphere of the tank house and this resulted in a rapid build-up of high-resistance corrosion spots which decreased the conductivity of the entire electrode. Such corrosion eventually caused enough structural damage to require replacement of the hanger bar and reconditioning of the cathode. In addition, when the copper plating became sufficiently worn to become inefficient as a conductor at the boundary between the hanger bar and the starter sheet, the current flow became restricted to the relatively high resistance weld spots and therefore affected the efficiency of the cathode as well.

U.S. Pat. No. 5,492,609 by Assenmacher overcame some of the problems associated with the Perry cathode. The hanger bar is of solid copper and has a longitudinally extending groove formed in the bottom surface thereof into which the upper edge of the starter sheet fits tightly. A continuous seam weld is used to provide improved boundary conductivity without the need for copper plating. The hanger bar is configured with a rounded in cross-section bottom surface to allow the cathode to rotate under the influence of gravity into a vertically disposed attitude to provide uniform spacing of the cathode relative to the adjacent anodes. Although Assenmacher disclosed a significantly improved structure, some problems remained unsolved. One such problem has been the galvanic corrosion that takes place at the junction of two dissimilar metals; that is, the stainless steel starter sheet and the copper hanger bar. The welding process which joins the starter sheet to the hanger bar causes a melting of both metals, which in turn produces a commingling of the two metals and brings a relatively large amount of dissimilar metal particles into contact with each other. Therefore, galvanic corrosion is increased by the enlarged interface produced by the melting of the two metals associated with the welding process. The greater interface between copper and steel along the weld bead is also exposed to the highly corrosive atmosphere of the tank house, which causes etching into the weld bead and which in time causes a decrease in electrical conductivity and eventually structural damage to the cathode.

Therefore, a need exists for a new and improved cathode structure for electrolytic refining of copper and a method of making same, with the improved cathode overcoming some of the shortcomings of the prior art.

SUMMARY OF THE INVENTION

A conventional electrolytic cathode includes a copper hanger bar with an elongated groove formed along the bottom longitudinal surface thereof and an edge of the cathode starter sheet positioned in the groove. According to the present invention, a special bond is formed at the junction of the cathode starter sheet and the hanger bar to mechanically and electrically couple them to each other in a manner which minimizes the area subject to galvanic corrosion. According to another aspect of the invention, a special coating is utilized in the immediate area of the copper bead to protect it from corrosion.

As used herein, the term "welding" refers to the process whereby two metallic parts are united by heating and allowing the metals to flow together in a mixture formed at the joint. The term "weld" is used to refer to such a welded joint. The term "brazing" is used to refer to the process whereby a copper-based alloy or a silver-based alloy is united to a metallic surface by heating to a temperature below the melting point of the metal, thereby avoiding flowing of the base metal and the formation of a mixture at the joint, although some fusion may occur at the interface between the brazing material and the base metal. The term "bond" is used to refer to a joint that may be either welded, brazed, or both, as defined herein.

The special bond of the invention is preferably formed by an arc-welding process using a pure copper rod. The amperage setting of the arc-welding equipment is set to generate a temperature at the weld site that is above the melting point of the copper but is below the melting point of the cathode starter sheet, which is preferably formed of stainless steel. Thus, the copper of the welding rod and the copper of the hanger bar will both be melted to produce a conventional welded joint at the junction thereof, and the junction of the rod and the cathode starter sheet will be in the form of a brazed bond in that the welding rod will be melted to bond with the unmelted starter sheet. Because little or no fusion takes place in brazing, the area of interface between steel and copper is held to a minimum by eliminating or at least substantially reducing the commingling of the two metals, thereby reducing the area that is subject to galvanic corrosion.

The special coating which protects the joint bead from corrosion is in the form of a metallic coating applied to the area to be protected using a thermal spray process. As is known in the art, thermal spray processes involve the spraying of molten metal onto a target area with the melting being accomplished by oxygen-fuel combustion or by an electric arc. The molten metal is accelerated by a flame, impacts the target area, and solidifies to form a cohesive low-porosity coating. There are several variations or types of thermal spray processes and it has been determined that the type referred to as High Velocity Oxygen Fuel Flame Spray (HVOF) is preferred in providing corrosion protection for weld beads according to the invention. The HVOF process is based on a special torch design in which a compressed oxygen fuel flame undergoes free expansion upon exiting the torch nozzle and in doing so achieves dramatic gas acceleration. The metal is injected at the back of the torch and exits the nozzle in a molten state and at a rate above supersonic velocity. Upon impacting the area to be coated, the molten metal spreads out and solidifies into a thin cohesive low-porosity coating.

Accordingly, it is an object of the present invention to provide an improved electrolytic cathode for use in the refining of copper and a method of making such a cathode.

Another object of the present invention is to provide an improved electrolytic cathode which includes a hanger bar and starter sheet of dissimilar metals which are mechanically and electrically interconnected by a special bond that reduces the copper/steel interface area and thereby minimizes the area that is subject to galvanic corrosion.

Another object of the present invention is to provide an improved electrolytic cathode of the above described character wherein the hanger bar is formed of copper and the starter sheet is formed of stainless steel and the special bond forms a conventional welded junction of the copper bead and the hanger bar and a brazed junction of the copper bead and the starter sheet.

Another object of the present invention is to coating is applied by a high velocity oxygen fuel flame spray process.

The foregoing and other objects of the present invention as well as the invention itself will be more fully understood when read in conjunction with the following drawings.

DESCRIPTION OF THE PREFERRED EMBODIMENT

Figure 1:
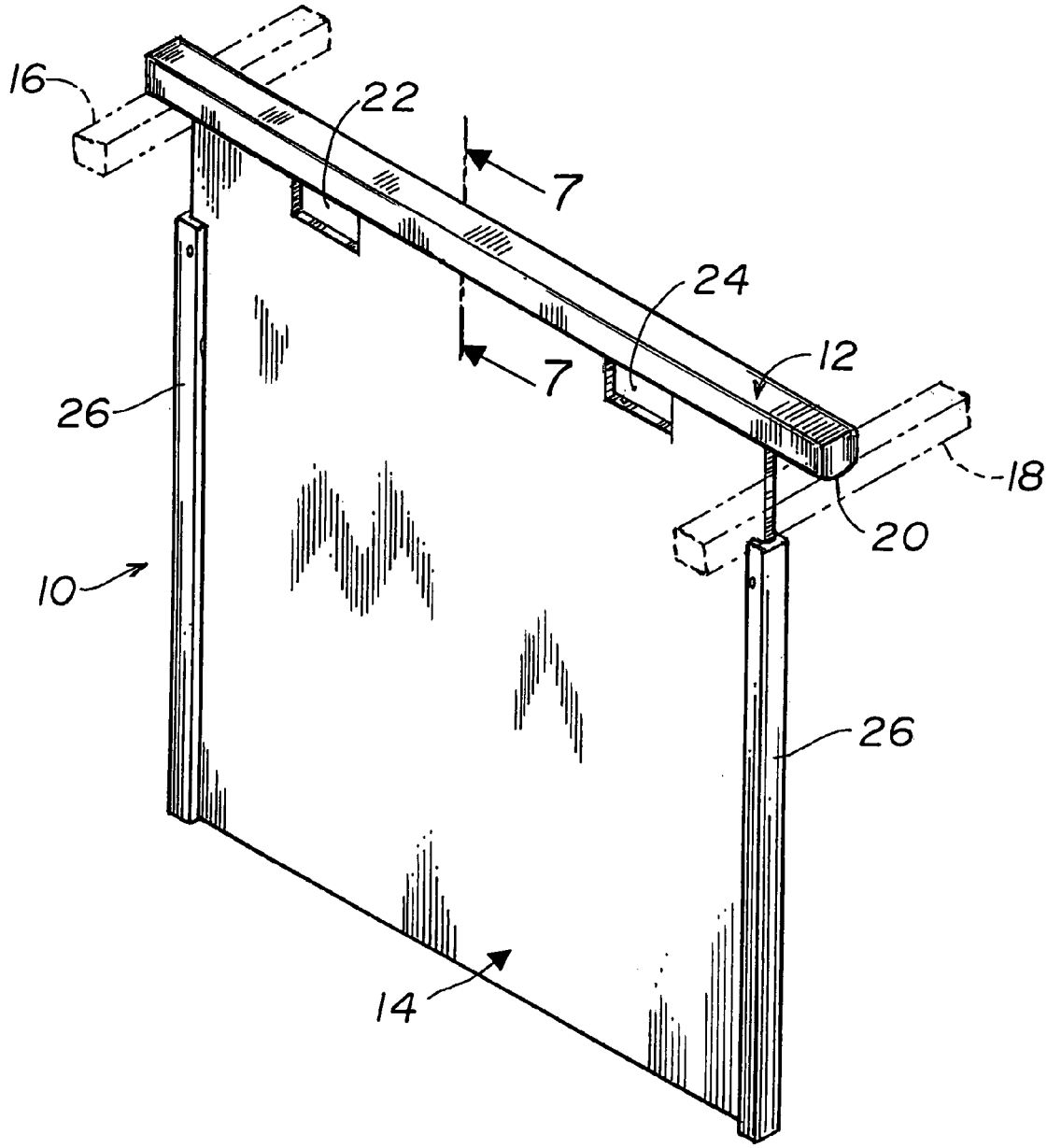
FIG. 1 is a perspective view showing an electrolytic cathode of the present invention in its operational position.

Referring more particularly to the drawings, FIG. 1 shows the electrolytic cathode of the present invention which is indicated generally by the reference numeral 10.

To insure a clear understanding of the invention, a brief description will now be presented of the operation and use of the cathode 10. Typically, the cathode 10 includes the major components of a header bar or hanger bar 12 and a starter sheet 14 which is sometimes referred to in the industry as a mother plate or mother blank. The cathode 10 is illustrated in its operational position wherein the opposite ends of the hanger bar 12 are supported on a spaced apart parallel pair of bus bars 16 and 18 which are shown in phantom lines. When supported in this manner, the starter sheet 14 depends from the hanger bar 12 between a pair of anodic plates (not shown). The starter sheet 14, and of course the anodic plates, are suspended in an electrolytic solution made up of a metal-rich electrolyte and other chemicals which includes a highly corrosive acid, with the solution being circulated through the cells of an extraction tank house. An electric current is passed through the anodes, electrolytic solution and the cathode and the resulting electrolysis produces the deposition of the metal on the surface of the cathode's starter sheet.

Figure 3:
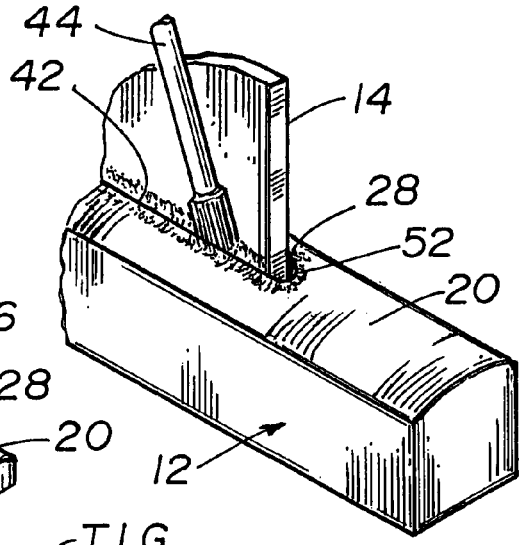
FIG. 3 is an enlarged fragmentary perspective view similar to FIG. 2 and illustrating a subsequent step of the method of the present invention.

As is customary, the hanger bar 12 is formed of solid copper has an elongated shape with an approximate length of 125 cm. a rectangular cross-section, and has an elongated surface 20 curved in cross-section (FIG. 3). In the operational position, the curved elongated surface 20 of the hanger bar 12 is the bottom surface thereof which rests on the bus-bars 16 and 18, so that the cathode 10 is free to rotate under the influence of gravity to bring the starter sheet 14 into a vertically depending attitude.

The starter sheet 14 is of planar configuration and is typically formed of a metal alloy, usually stainless steel, with a thickness of approximately 3.2 mm, and is approximately one meter square. The starter sheet 14 has a pair of windows 22 and 24 which provide openings for mechanical handling of the cathode 10 by automated equipment, and the starter sheet also includes a pair of elongated strips 26 installed along opposite vertical edges of the sheet to rigidify it and to prevent electro-deposition of metal along those edges.

Reference is now made to FIGS. 2 through 6, wherein the steps of the method of the present invention are illustrated with the cathode 10 being shown in an inverted position relative to the operational position thereof shown in FIG. 1. It will be apparent as this description progresses that the inverted position is the most convenient position for accomplishing those manufacturing steps.

Figure 2:
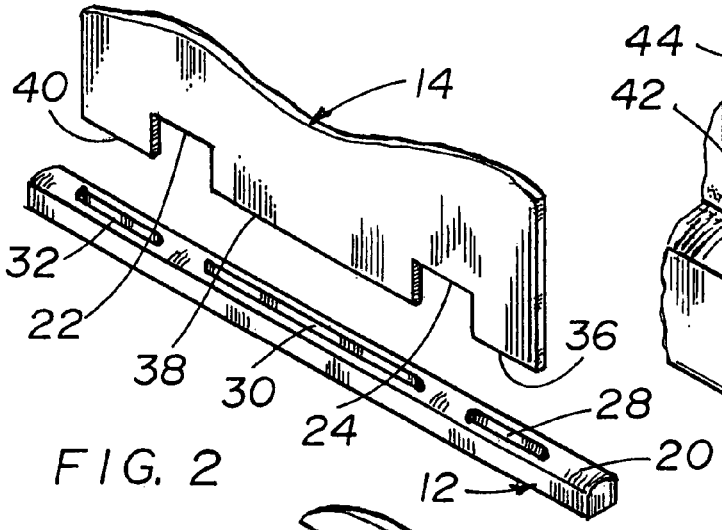
FIG. 2 is a perspective view showing the hanger bar and a fragmentary portion of the starter sheet in an inverted position for manufacturing purposes with this view showing the first steps of the method of the present invention.

FIG. 2 shows the initial step of milling or otherwise forming three longitudinally aligned grooves 28, 30 and 32 in spaced apart locations along the length of the surface 20 of the hanger bar 12. The next step is that of forming the windows 22 and 24 in the starter sheet 14 so that the windows open up onto one edge 34 of the starter sheet, and divide that edge into three spaced apart land areas 36, 38 and 40. The spacing of the windows 22 and 24 and the land areas 36, 38 and 40 of the starter sheet 14 are formed to match the spacing of the grooves 28, 30 and 32 of the hanger bar 12, and the next step involves installing the land areas 36, 38 and 40 in the grooves 28, 30 and 32, respectively. The grooves are formed in the hanger bar with width dimensions that are sized so that the land areas of the starter sheet 14 fit tightly without having to be forced, and the grooves are formed with a depth dimension of about 6.4 mm which has been found to be optimal for providing sufficient contact for the welding step to follow.

FIG. 3 shows the next step of the present method which is applying a weld conditioning substance 42, such as with a suitable brush 44, to the metals of the hanger bar 12 and the starter sheet 14 in the areas thereof which are to be bonded. A weld conditioning substance such as a conventional bi-metal flux may be used.

Figure 4:
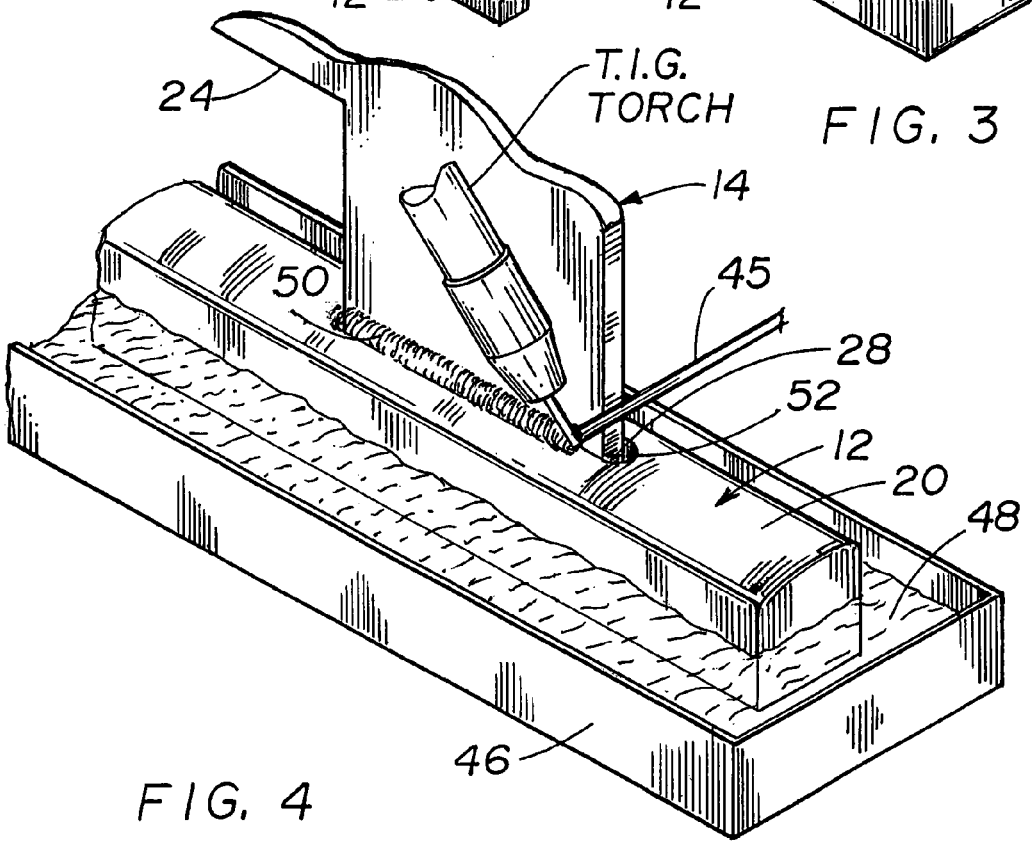
FIG. 4 is a fragmentary perspective view similar to FIGS. 2 and 3 and showing further steps of the method of the present invention.

FIG. 4 shows the next step as being the joining of the hanger bar 12 and the starter sheet 14 by employing a special bonding technique. This step is preferably performed by arc-welding in a tungsten inert gas (T.I.G.) process with a pure copper rod 45. In order to insure a uniform joint, it is critical that the heat generated by the welding process be distributed uniformly along the hanger bar 12 and hot spots be avoided. Accordingly, it is advisable to couple a portion of the hanger bar to an efficient and evenly distributed heat sink during the bonding process. For example, the hanger bar 12 may be partially immersed in a container 46 of a suitable thermally conductive liquid 48, with the liquid being circulated at a rate which maintains the temperature of the hanger bar 12 as constant and uniform as is practically possible. The special bonding process mentioned above involves setting the voltage of the T.I.G. welding equipment at a value so that the temperature generated at the weld site is above the melting point of copper but below the melting point of the stainless steel. This results in a welded joining of the copper bead 50 with the copper of the hanger bar 12 and a brazed joining of the copper bead 50 with the stainless steel of the starter sheet 14. It will be noted that the groove run-out areas 52 are also closed by this process to prevent corrosive etching behind the copper bead.

In order to achieve the weld/braze balance necessary to weld the weld bead to the copper hanger bar 12 while only brazing it to the stainless-steel starter sheet 14, it may be convenient to direct the welding torch prevalently toward the hanger bar to control the relative distribution of heat produced by the welding process. Such a technique may be used advantageously by one skilled in the art to effect the required degree of welding at the copper/copper interface and to ensure at the same time, that the copper/stainless-steel interface is bonded by brazing.

Figure 5:
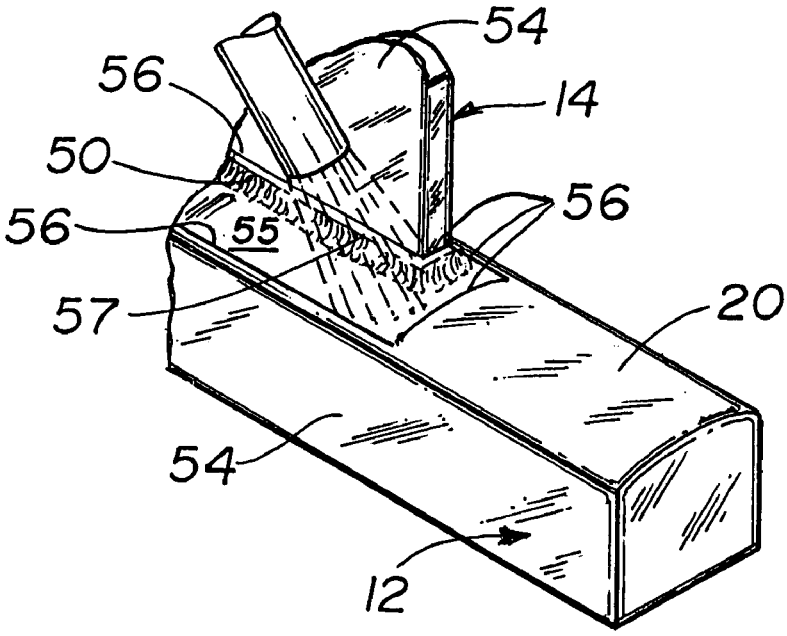
FIG. 5 is a fragmentary perspective view similar to FIGS. 2, 3 and 4 and showing still further steps of the method of the present invention.

The next step is shown in FIG. 5 and involves masking the hanger bar 12 and the starter sheet 14 with a suitable material 54 such as PVC or CPVC plastic, so that only an area 55 adjacent the copper bead 50 is exposed as defined by the edges 56 of the masking material 54. The next step is vapor blasting of the un-masked exposed area 55 of the hanger bar 12, the starter sheet 14 and the copper bead 50 with a suitable blasting medium 57, such as aluminum oxide.

Figure 6:
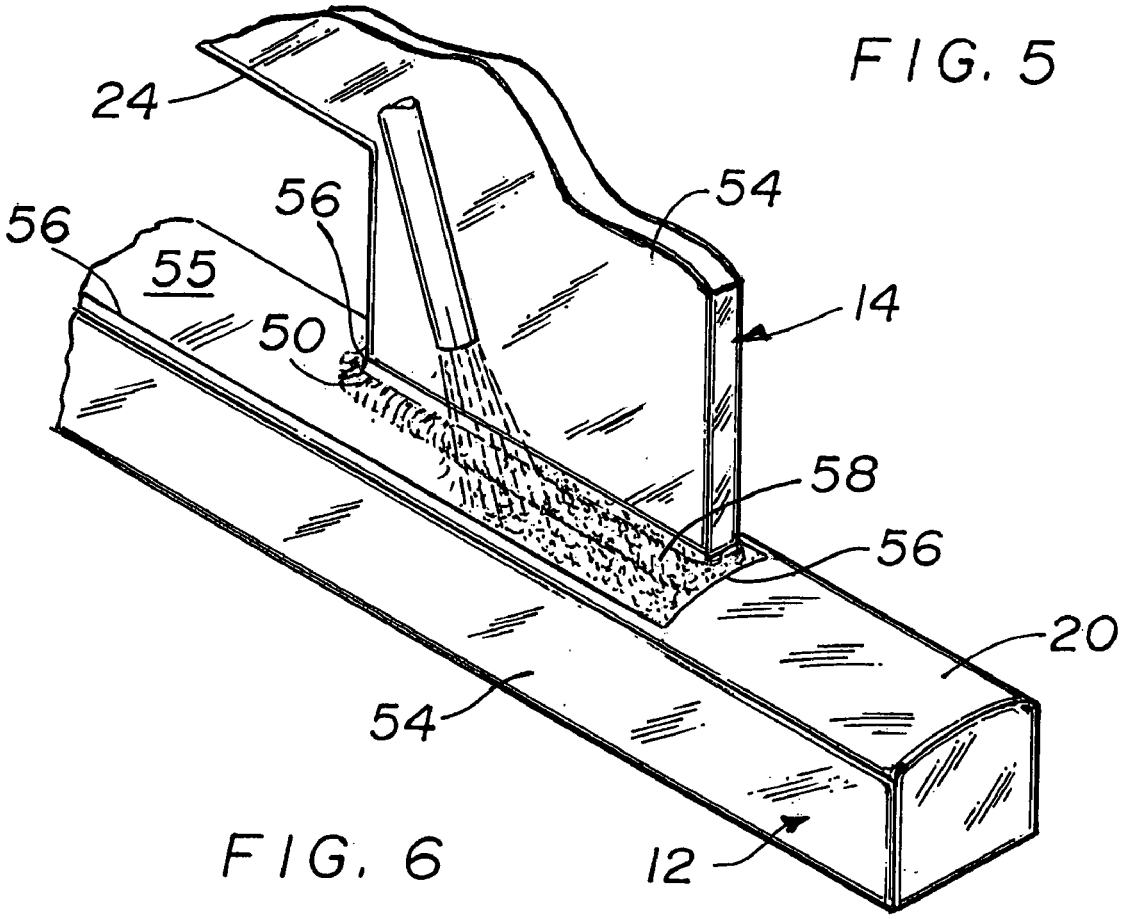
FIG. 6 is a fragmentary perspective view similar to FIGS. 2, 3, 4, and 5 and illustrating the final steps of the method of the present invention.

The vapor blasting prepares the exposed areas 55 of the hanger bar 12, the starter sheet 14 and the copper bead 50 for the next step, illustrated in FIG. 6. This step involves applying a protective coating 58 on the exposed area 55 to prevent corrosive etching thereof using a thermal spray process. There are several types of thermal spray processes; namely, electric arc, plasma, combustion flame, vacuum plasma and HVOF (an acronym for high velocity oxygen fuel flame). HVOF is preferred in that the coatings applied by this process have been found to provide superior corrosion protection. The HVOF process used to practice the invention is a well known combustion flame process. A compressed flame undergoes free expansion upon exiting the torch nozzle and in doing so accelerates to a supersonic velocity. A suitable powdered metal feed stock is injected at the back of the torch and is carried with the expanding flame in a molten state to impinge on the target area at supersonic velocity. The impinging molten metal spreads out into a very thin cohesive low-porosity layer and provides the coating with excellent corrosion-resistant properties. Many different metals may be used for this purpose, but 316L stainless steel in powder form is preferred because it is readily available and relatively inexpensive in comparison to other available metals. The final step of the method of the invention is the removal of the masking material 54, which readies the cathode 10 for use.

Figure 7:
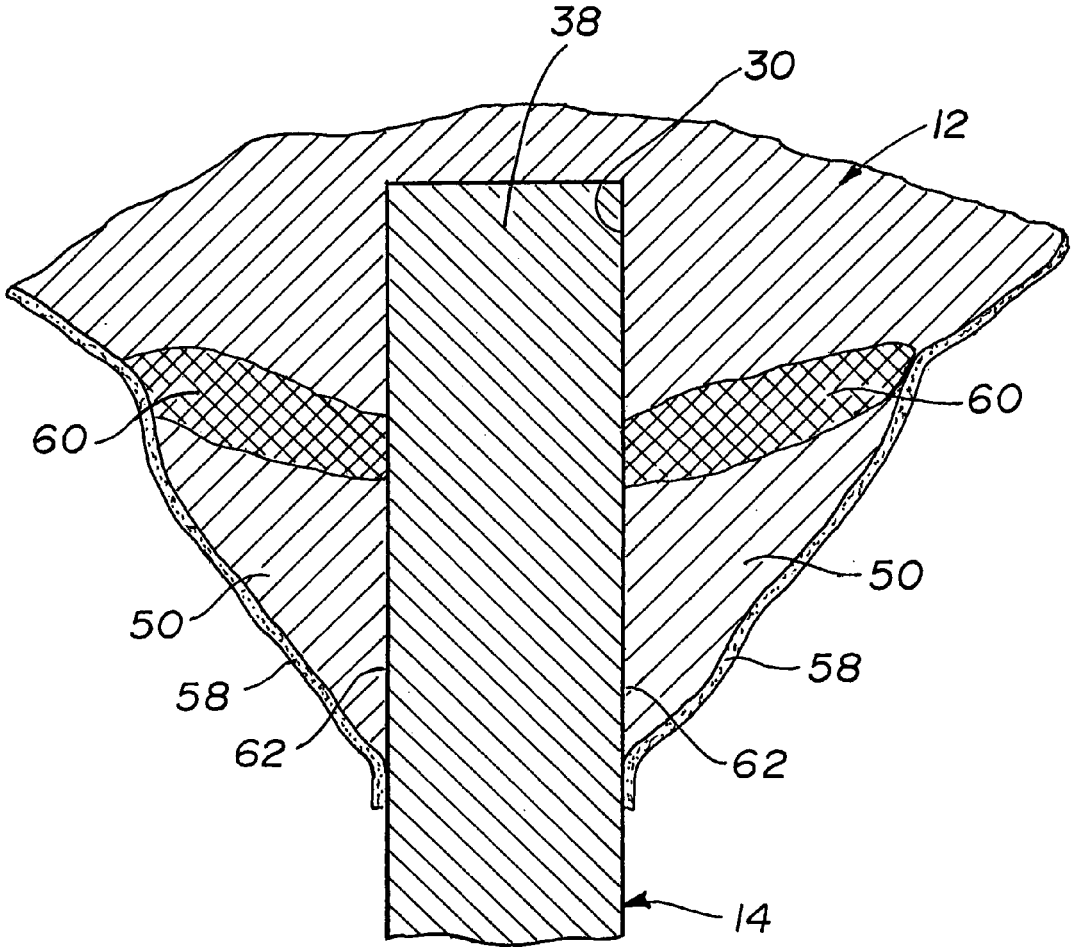
FIG. 7 is an enlarged fragmentary sectional view taken along the line 7—7 of FIG. 1.

Reference is now made to FIG. 7, wherein the improved characteristics of the copper bead 50 formed by the method of the present invention are shown. As hereinbefore described, the special bonding step produces a welded joint between the copper bead 50 and the copper hanger bar 12. Such joints, resulting from melting of the metals at the interface thereof, includes an area 60 of commingled metal. Because the temperature produced at the weld site is below the melting point of the stainless steel starter sheet 14, the brazed joint between the weld bead 50 and the starter sheet reflects little or no fusion at the interface 62 thereof. Thus, the area of contact between the two dissimilar metals is minimized and galvanic corrosion is similarly minimized.

While the principles of the invention have now been made clear in an illustrated embodiment, many modifications will be obvious to those skilled in the art which do not depart from those principles. The appended claims are therefore intended to cover such modifications within the limits only of the true spirit and scope of the invention.

What I claim is:

1. A method of manufacturing an electrode for an electrolytic process comprising the following steps:

a) milling a longitudinally extending groove in an elongated hanger bar made of a first metal;

b) providing a planar starter sheet made of a second metal and having a top edge;

c) inserting the top edge of the starter sheet into the groove of the hanger bar; and d) welding the hanger bar to a bead of material made substantially of said first metal and brazing said bead to the starter sheet, thereby forming a bonded joint between the hanger bar and the starter sheet.

2. The method of claim 1, wherein said first metal includes copper.

3. The method of claim 1, wherein said second metal is stainless steel.

4. The method of claim 1, wherein said first metal includes copper and said second metal is stainless steel.

5. The method of claim 4, including the further step of applying a corrosion-resistant protective coating of stainless steel on the bonded joint after step (d).

6. An electrode manufactured according to the method of claim 4.

7. The method of claim 1, including the further step of applying a weld conditioner along the groove of said hanger bar and an adjacent portion of said starter sheet after step (c) and before step (d).

8. The method of claim 1, including the further step of applying a corrosion-resistant protective coating on the bonded joint after step (d).

9. The method of claim 8, wherein the corrosion-resistant protective coating is metallic.

10. The method of claim 1, including the further steps of:

e) applying a masking material to said hanger bar and starter sheet so that the bonded joint remains exposed;

f) cleaning the bonded joint with a vapor blast;

g) applying a metallic corrosion-resistant protective coating on the bonded joint with a thermal spray technique; and h) removing the masking material.

11. The method of claim 10, wherein the thermal spray technique used to apply the corrosion-resistant protective coating is a high velocity oxygen fuel flame spray technique.

12. An electrode manufactured according to the method of claim 1.

13. The method of claim 12, wherein said first metal includes copper and said second metal is stainless steel.

14. The method of claim 13, including the further step of applying a corrosion-resistant protective coating of stainless steel on the bonded joint after step (d).

15. The method of claim 12, including the further step of applying a corrosion-resistant protective coating on the bonded joint after step (d).

16. A method of manufacturing an electrode for an electrolytic process comprising the following steps:

a) milling a longitudinally extending groove in an elongated hanger bar made of a first metal;

b) providing a planar starter sheet made of a second metal and having a top edge;

c) inserting the top edge of the starter sheet into the groove of the hanger bar; and d) forming a bonded joint between the hanger bar and the starter sheet using a bead of material made substantially of said first metal in a bonding process that includes the the step of generating heat above a melting point of said first metal and below a melting point of said second metal.

17. An electrode manufactured according to the method of claim 16.

18. A method of protecting a bonded joint between a hanger bar and a starter sheet, comprising the following steps:

a) applying a masking material to said hanger bar and starter sheet so that the bonded joint remains exposed;

b) cleaning the bonded joint with a vapor blast;

c) applying a metallic corrosion-resistant protective coating on the bonded joint with a thermal spray technique; and d) removing the masking material.

19. The method of claim 18, wherein said hanger bar is made of copper, said starter sheet is made of stainless steel, the protective coating used in step (c) is stainless steel, and the thermal spray technique is a high velocity oxygen fuel flame spray technique.

20. A bonded joint protected according to the method of claim 19.

* * * * *